United States Patent [19]

Seliga

[11] Patent Number: 4,558,533

[45] Date of Patent: Dec. 17, 1985

[54] PISTOL GRIPS WITH COUNTERBALANCING PLATFORMS

[76] Inventor: Gerald W. Seliga, 324 Greenfield La., Frankfort, Ill. 60423

[21] Appl. No.: 584,518

[22] Filed: Feb. 28, 1984

[51] Int. Cl.[4] ..... F41C 23/00

[52] U.S. Cl. ..... 42/71 P; 42/72

[58] Field of Search ..... 42/1 W, 71 R, 71 P, 42/72, 94, 7

[56] References Cited

U.S. PATENT DOCUMENTS

| | | | |
|---|---|---|---|
| 914,675 | 3/1909 | Renfors | 42/72 |
| 1,224,902 | 5/1917 | Chylewski | 42/7 |
| 2,458,608 | 1/1949 | Lea | 42/94 |
| 2,460,598 | 2/1949 | Rosvall | 42/7 |
| 3,128,571 | 4/1964 | Herrett | 42/71 P |
| 3,184,877 | 5/1965 | Andrews | 42/72 |
| 3,384,988 | 5/1968 | Salaiz | 42/71 P |
| 3,648,396 | 3/1972 | Smith | 42/72 |

*Primary Examiner*—Charles T. Jordan
*Assistant Examiner*—Ted L. Parr
*Attorney, Agent, or Firm*—John Vander Weit, Jr.

[57] ABSTRACT

A pistol grip for use with a pistol having a barrel with a predetermined line of flight of a bullet and a predetermined center of gravity, including a grip which is affixed to the pistol, a platform extending from the grip, and a support portion of the platform extending away from the grip such that at least one point of the support portion of the platform is vertically below the center of gravity when the line of flight of a bullet is raised 5° from horizontal.

18 Claims, 4 Drawing Figures

FIG. 1
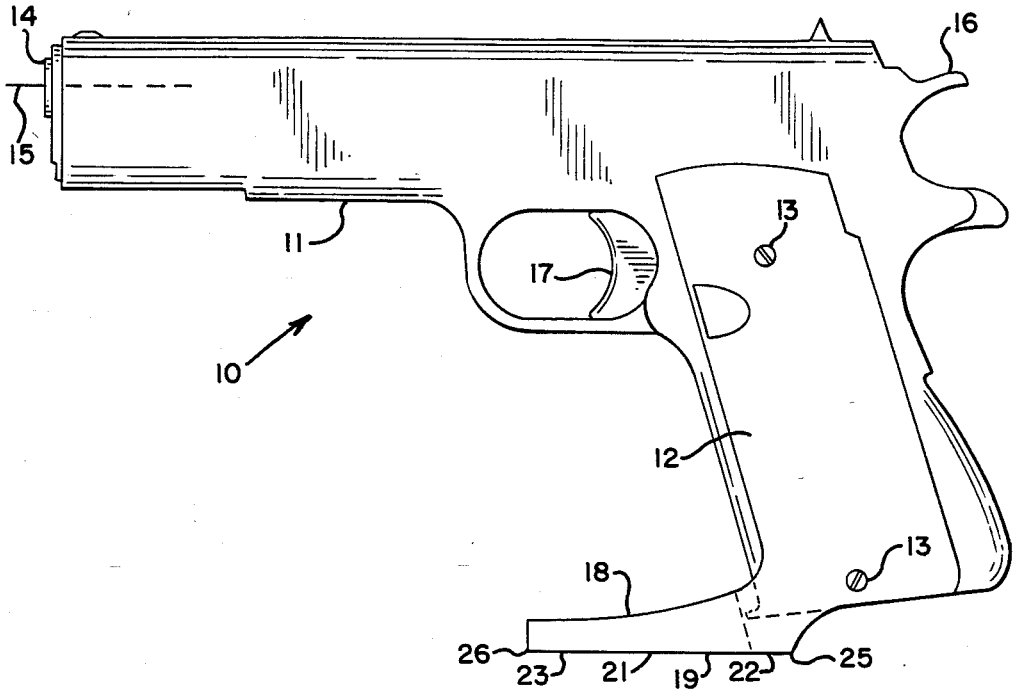
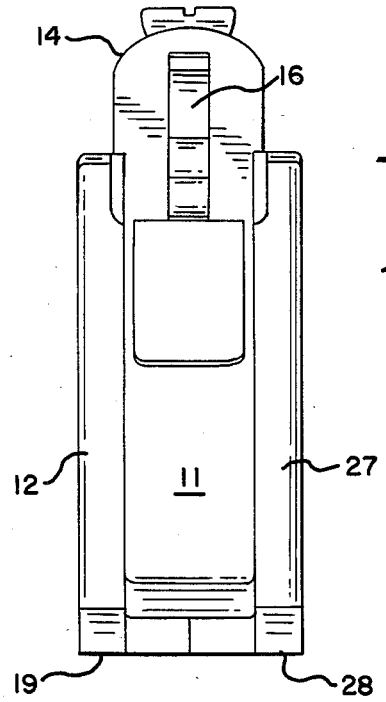
FIG. 2

PISTOL GRIPS WITH COUNTERBALANCING PLATFORMS

BACKGROUND OF THE INVENTION

The present invention relates to a product useful as a pistol grip and more specifically a product which allows for more accurate firing from a support position.

Target practice and pistol competition have become a popular pastime of many people. Various different pistol grips have been developed to aid in firing pistols. Some are designed based on right or left handed firing. Others are designed to compensate for different hand sizes. Still others have specific patterns which increase the friction or ability to grip the pistol handle. However, due to the weight of a pistol, the geometry of a pistol, and the force of recoil when firing, a person still had to provide most of the support for the pistol. This was true even when firing the pistol from a supported position, such as from a bench rest or prone position.

Hence an object of the invention is to provide a pistol grip for use with pistols which will surely and firmly support the pistol during firing from a support position.

Another object of the invention is to provide a pistol grip which will support the pistol with minimum effort by the user.

Still another object of the invention is to provide a pistol grip which will improve the accuracy of the user when firing from a support surface.

Still another object of the invention is to provide a pistol grip which allows use of both hands of a user to counterbalance each other and improve accuracy without a support surface.

In accordance with the present invention, a pistol grip is provided which will allow for support of a pistol while firing from a support surface and counterbalance support when not fired from a support surface and consequently improve accuracy.

SUMMARY OF THE INVENTION

In accordance with the invention a pistol grip is provided for use with a pistol having a barrel with a predetermined line of flight of a bullet and a predetermined center of gravity, including a grip which is affixed to the pistol, a platform extending from the grip, and a support portion of the platform extending away from the grip such that at least one point of the support portion of the platform is vertically below the center of gravity when the line of flight of a bullet is raised 5° from horizontal.

BRIEF DESCRIPTION OF THE DRAWINGS

Other objects and advantages of the invention will become apparent upon reading the following detailed description and upon reference to the drawings, in which:

FIG. 1 is a side view of a pistol having a pistol grip designed according to the instant invention;

FIG. 2 is a rear view of the pistol having a pistol grip of FIG. 1;

Figure 3:
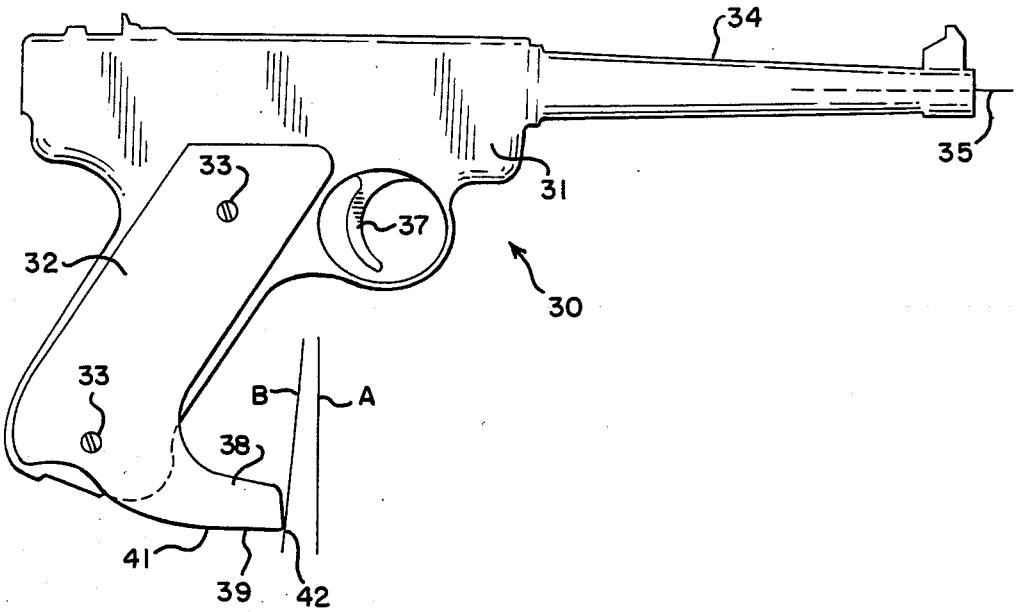
FIG. 3 is a side view of another pistol having a pistol grip designed according to the instant invention.

While the invention will be described in connection with a preferred embodiment, it will be understood that it is not intended to limit the invention to that embodiment. On the contrary, it is intended to cover all alternatives, modifications and equivalents as may be included within the spirit and scope of the invention as defined by the appended claims.

DETAILED DESCRIPTION OF THE PREFERRED EMBODIMENT

Turning first to FIG. 1, there is shown a pistol 10 incorporating the pistol grips of the instant invention. Pistol 11 has a pistol grip 12 constructed in accordance with the instant invention affixed to it by fasteners 13. Pistol 11 can be, for example, a 45 caliber Colt government model 1911A1 as is shown, or other similar 45 caliber pistols. Pistol 11 has a barrel 14 with a predetermined line of flight 15 which a bullet will follow when fired from pistol 11. Pistol 11 also has a hammer 16 and trigger 17. The pistol also has a clip (now shown) which can contain a maximum of eight bullets. Grip 12 includes a platform 18 which extends from grip 12 and has a lowermost portion 19 which is substantially parallel to line of flight 15. Pistol 11 has a first center of gravity when loaded with one bullet which is vertically above point 21. Pistol 11 has a second center of gravity when fully loaded with bullets located vertically above point 22. Lowermost portion 19 extends substantially parallel to line of flight 15 from both points 21 and 22 and beyond. When line of flight 15 is displaced 20° below horizontal, the first center of gravity of pistol 11 having one bullet in its clip would be vertically above point 23. When pistol 11 has line of flight 15 displaced 20° above horizontal, the second center of gravity or fully loaded clip would cause the center of gravity of pistol 11 to be displaced vertically above point 25. Lowermost portion 19 of pistol grip 12 extends substantially parallel to line of flight 15 from point 23 to point 25.

During use of pistol 10, one can rest lowermost portion 19 upon the support surface which may be flat if it is a bench surface or the ground if it is a prone position. Thus, the pistol would stand freely by itself, and allow aiming and firing of the pistol with a minimum of effort or strength by the user. Moreover, during recoil on a flat surface the pistol would not tend to pivot along a point contact but instead tend to slide along the entire surface of lowermost portion 19. Accordingly, the user can achieve more accuracy since his strength is usable for supporting and guiding the pistol rather than carrying or balancing the weight of the pistol. When firing at a target that is displaced from a horizontal line of flight 15, the support surface for the pistol would with downward displacement lines of flight be front portion 26. For targets displaced vertically above the horizontal, rear portion 25 will support the pistol. While the pistol will not stand freely along front portion 26 or rear portion 25 of grip 12, since they are so close to the center of gravities of the pistol during use, they will allow for substantially most of the weight of the pistol to be supported by the support surface.

Turning to FIG. 2, the pistol 11 of FIG. 1 is shown from the rear. Pistol 11 has barrel 14, hammer 16 and shows grip 12 with flat lowermost portion 19. Pistol 11 has grip 27 with a flat lowermost portion 28 which is similar to grip 12 and attached to the opposite side of pistol 11.

Turning to FIG. 3, there is shown a pistol 30 incorporating the pistol grips of the instant invention. Pistol 31 has a pistol grip 32 constructed in accordance with the instant invention affixed to it by fasteners 33. Pistol 31 can be, for example, a Ruger Mark II 0.22 cal long rifle six inch barrel as is shown, or other similar 22 caliber pistols. Pistol 31 has a barrel 34 with a predetermined line of flight 35 which a bullet will follow when fired from pistol 31. Pistol 31 also has trigger 37. The pistol also has a clip (not shown) for bullets. Grip 32 includes a platform 38 which extends from grip 32 and has a lowermost portion 39 which is substantially parallel to line of flight 35. Pistol 31 has a center of gravity when fully loaded with bullets located vertically above and along line A. Lowermost portion 39 extends substantially parallel to line of flight 35 from point 41 to point 42. When pistol 31 has line of flight 35 displaced 5° above horizontal, the center of gravity of pistol 31 with a fully loaded clip would cause the center of gravity of pistol 31 to be displaced vertically above and along line B. Platform 38 of pistol grip 32 extends away from pistol 31 to a point which is vertically below the center of gravity when line of flight 35 is raised 5° from horizontal.

During use of pistol 30, one can rest lowermost portion 39 upon the support surface which may be flat if it is a bench surface or the ground if it is a prone position. Although the pistol would not stand freely by itself, it would allow aiming and firing of the pistol with a minimum of effort or strength by the user. Moreover, during recoil on a flat surface the pistol would not tend to pivot along a point contact but instead tend to slide along entire surface of lowermost portion 39. Accordingly, the user can achieve more accuracy since his strength is usable for supporting and guiding the pistol rather than carrying or balancing the weight of the pistol. When firing at a target that is displaced from a horizontal line of flight 35, the support surface for the pistol would with downward displacement lines of flight be front point 42. For targets displaced vertically above the horizontal, rear point 41 will support the pistol. While the pistol will not stand freely along front point 42 or rear point 41 of grip 32, since they are so close to the center of gravities of the pistol during use, they will allow for substantially most of the weight of the pistol to be supported by the support surface.

Grip 32 is particularily effective as a counterbalance when not firing from a support surface. Thus, when firing from a standing position, a user may use a two-handed counterbalance grip. This is done by having one hand on the trigger holding the pistol and exerting a force which would cause the line of flight of the bullet to rise and having the other hand on platform 38 and exerting a force which would cause the line of flight of the bullet to lower. By having each hand exerting a balanced amount of pressure in opposite directions a much firmer and more accurate grip is obtainable. This counterbalancing with a two-handed grip will significantly reduce muzzle jump, jerking, flinching and other movements during aiming and firing the pistol. A user may try different counterbalance pressures until one that is comfortable is found. For rapid fire, more pressure may be necessary to keep muzzle jump to a minimum.

Figure 4:
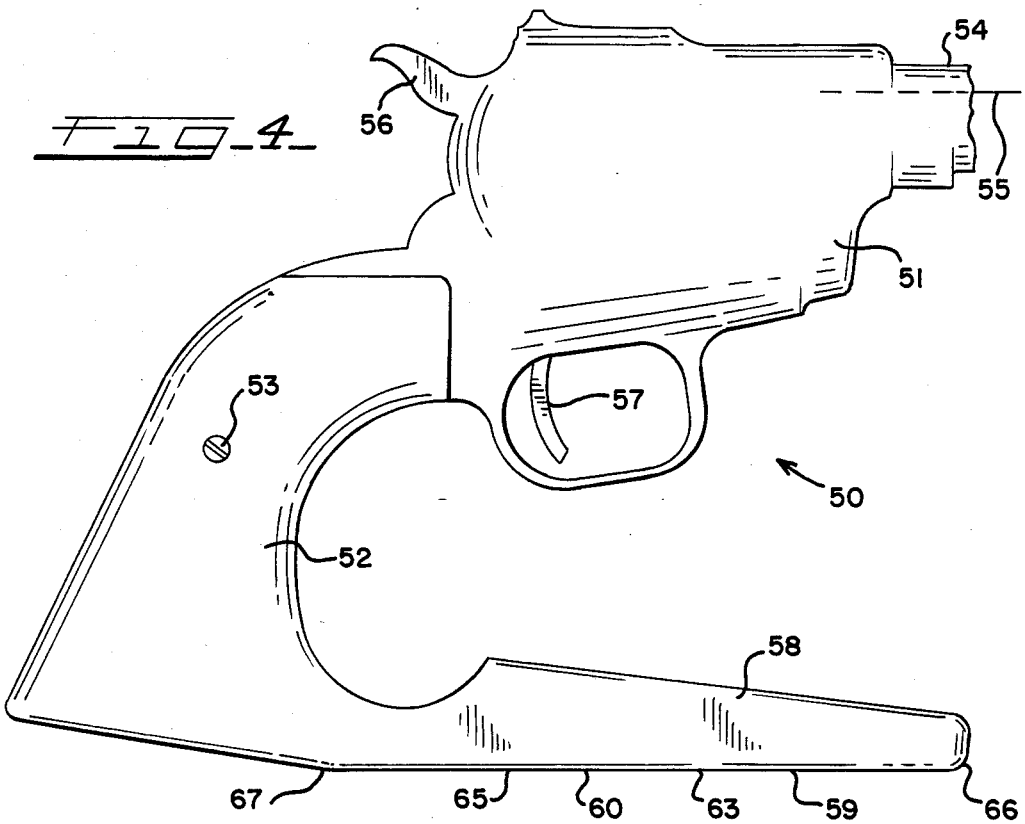
FIG. 4 is a partial side view of still another pistol having a pistol grip designed according to the instant invention.

In FIG. 4, there is shown a pistol 50 incorporating the pistol grips of the instant invention. Pistol 51 has a pistol grip 52 constructed in accordance with the instant invention affixed to it by fasteners 53. Pistol 51 can be, for example, a 0.22 single six Ruger as is shown, or other similar 22 caliber pistols. Pistol 50 has a barrel 54 with a predetermined line of flight 55 which a bullet will follow when fired from pistol 51. Pistol 51 also has a hammer 56 and trigger 57. Grip 52 includes a platform 58 which extends from grip 52 and has a lowermost portion 59 which is substantially parallel to line of flight 55. Pistol 51 has a center of gravity which is vertically above point 60. When line of flight 55 is displaced 15° above horizontal, the center of gravity of pistol 51 would be vertically above point 63. When pistol 51 has line of flight 55 displaced 15° below horizontal, the center of gravity of pistol 51 is displaced vertically above point 65. Lowermost portion 59 of pistol grip 52 extends substantially parallel to line of flight 55 from point 63 to point 65.

During use of pistol 50, one can rest lowermost portion 59 upon the support surface which may be flat if it is a bench surface or the ground if it is a prone position. Thus, the pistol would stand freely by itself, and allow aiming and firing of the pistol with a minimum of effort or strength by the user. Moreover, during recoil on a flat surface the pistol would not tend to pivot along a point contact but instead tend to slide along the entire surface of lowermost portion 59. Accordingly, the user can achieve more accuracy since his strength is usable for supporting and guiding the pistol rather than carrying or balancing the weight of the pistol. When firing at a target that is displaced from a horizontal line of flight 55, the support surface for the pistol would with downward displacement lines of flight be front portion 66. For targets displaced vertically above the horizontal, rear portion 67 will support the pistol.

All the pistol grips shown, may be used with counterbalancing grips for two-handed firing and it is preferred to have the platform of the grip extend to under the center of gravity of the pistol. The minimum desired length of the platform is to a point which is under the center of gravity of the pistol when the line of flight of a bullet is raised 5° from horizontal. This is necessary so that a user has a sufficient lever arm to exert a significant counterbalance force. However, it is preferred that the platform extend at least as far as the center of gravity of the pistol. Then the pistol may stand freely by itself on a support surface without being held. It would rest entirely on its lowermost portion. For both counterbalance firing and support surface firing, it is desirable to have the grip platform extend so that it is under the center of gravity of the pistol when the line of flight of a bullet is raised or lowered 15° from horizontal. Sometimes, a 15° spread may cause too large of a platform and having the center of gravities of the pistol vertically above the platform for 10° raising or lowering of the line of flight of the bullet is adequate. There is also an advantage to having a 5° spread, wherein the center of gravities of the pistol are vertically above the platform and its lowermost portion for 5° raising or lowering of the line of flight of the bullet, when most of the firing of the pistol is not going to be horizontal or when the support area is rough. Then the front point and rear point of the grip platform will allow pivoting of the pistol on a support surface more near to the center of gravity of the pistol. Thus, for firing in a non-horizontal direction, it is most preferred to have a small flat lowermost portion of the grip platform which extends under the center of gravities of the pistol with a load of one bullet and a full load of bullets so as to allow the front and rear pivot points to be as close as possible to the center of gravities when fired non-horizontally while still obtaining the benefits of a flat support and counterbalancing system.

Thus, it is apparent that there has been provided, in accordance with the invention, a product that fully satisfies the objects, aims, and advantages set forth above.

While the invention has been described in conjunction with specific embodiments thereof, it is evident that many alternatives, modifications and variations will be apparent to those skilled in the art in light of the foregoing description. Accordingly, it is intended to embrace all such alternatives, modifications and variations as fall within the spirit and broad scope of the appended claims.

I claim:

1. A pistol grip for use with a pistol having a barrel with a predetermined line of flight of a bullet and said pistol having a predetermined center of gravity, including:

a grip which is affixed to said pistol;

a platform extending from said grip; and a support portion of said platform extending away from said grip in a length allowing a user to exert a force which would cause the line of flight of a bullet to lower and having at least one point of said support portion of said platform on a vertical line passing through said center of gravity when said line of flight of a bullet is raised 5° from horizontal.

2. A pistol grip as in claim 1 wherein said predetermined center of gravity is measured with said pistol fully loaded with bullets.

3. A pistol grip as in claim 1 wherein said predetermined center of gravity is measured with said pistol loaded with one bullet.

4. A pistol grip as in claim 1 wherein said predetermined center of gravity is the average between said pistol being fully loaded with bullets and loaded with one bullet.

5. A pistol grip as in claim 1 wherein at least one point of said support portion of said platform is on a vertical line passing through said center of gravity when said line of flight of a bullet is lowered 5° from horizontal.

6. A pistol grip as in claim 1 wherein at least one point of said support portion of said platform is on a vertical line passing through said center of gravity when said line of flight of a bullet is horizontal.

7. A pistol grip as in claim 6 wherein said predetermined center of gravity is measured with said pistol being unloaded.

8. A pistol grip as in claim 6 wherein said predetermined center of gravity is measured with said pistol being fully loaded with bullets.

9. A pistol grip for use with a pistol having a barrel with a predetermined line of flight of a bullet, said pistol having a first center of gravity when loaded with one bullet, and a second center of gravity when fully loaded with bullets, including:

a grip which is affixed to said pistol;

a platform extending from said grip in a length allowing a user to exert a force which would cause the line of flight of a bullet to lower;

a support portion located on the lowermost surface of said platform; and said support portion of said platform being of a length such that said first and second center of gravities are on a vertical line passing through said support portion of said platform wherein said support portion of said platform allows said pistol to stand freely.

10. A pistol grip as in claim 9 wherein said support portion of said platform is of a length such that when the line of flight of a bullet is raised or lowered 5° from horizontal that such first and second center of gravities are on vertical lines passing through said support portion of said platform.

11. A pistol grip as in claim 9 wherein said support portion of said platform is of a length such that when the line of flight of a bullet is raised or lowered 10° from horizontal that such first and second center of gravities are on vertical lines passing through said support portion of said platform.

12. A pistol grip as in claim 9 wherein said support portion of said platform is substantially parallel to said line of flight of said bullet and is the lowermost portion of said pistol grip.

13. A pistol grip as in claim 12 wherein said support portion of said platform is of a length such that when the line of flight of a bullet is raised or lowered 5° from horizontal that such first and second center of gravities are on vertical lines passing through said support portion of said platform.

14. A pistol grip as in claim 12 wherein said support portion of said platform is of a length such that when the line of flight of a bullet is raised or lowered 10° from horizontal that such first and second center of gravities are on vertical lines passing through said support portion of said platform.

15. A pistol grip for use with a pistol having a barrel with a predetermined line of flight of a bullet, said pistol having a first center of gravity when loaded with one bullet, and a second center of gravity when fully loaded with bullets, including:

a grip which is affixed to said pistol;

a platform extending from said grip; and said platform being a length allowing a user to exert a force which would cause the line of flight of a bullet to lower and such that when the line of flight of a bullet is horizontal that said first and second center of gravities are vertically above said platform.

16. A pistol grip as in claim 15 wherein said platform is of a length such that when the line of flight of a bullet is lowered 5° from horizontal that said first and second center of gravities are on vertical line passing through said platform.

17. A pistol grip as in claim 15 wherein said platform is of a length such that when the line of flight of a bullet is lowered 10° from horizontal that said first and second center of gravities are on vertical lines passing through said platform.

18. A pistol grip as in claim 15 wherein said platform is of a length such that when the line of flight of a bullet is lowered 15° from horizontal that said first and second center of gravities are on vertical lines passing through said platform.

* * * * *